US005176503A

United States Patent [19]

Palmer et al.

[11] Patent Number: 5,176,503

[45] Date of Patent: Jan. 5, 1993

[54] POND WATER DESTRATIFIER

[76] Inventors: Jerry D. Palmer, 2707 Proper St.; Roy K. Williams, Rte. 8, Box 429, both of Corinth, Miss. 38834

[21] Appl. No.: 866,509

[22] Filed: Apr. 10, 1992

Related U.S. Application Data

[62] Division of Ser. No. 668,183, Mar. 12, 1991.

[51] Int. Cl.[5] ..... F04B 21/08

[52] U.S. Cl. ..... 417/61; 415/6

[58] Field of Search ..... 417/61; 415/6

[56] References Cited

U.S. PATENT DOCUMENTS

| | | | |
|---|---|---|---|
| 3,322,10 | 2/1866 | Ahlenius | 261/120 |
| 2,877,051 | 3/1959 | Cushman et al. | 415/6 |
| 3,426,688 | 2/1969 | Jones | 415/6 |
| 3,561,738 | 2/1971 | Galeano | 261/120 |
| 3,589,497 | 6/1971 | Grutsch et al. | 261/120 |
| 3,595,538 | 7/1971 | Baumann | 261/120 |
| 3,759,495 | 9/1973 | Boler et al. | 261/120 |
| 3,802,673 | 4/1974 | Ross | 210/242.2 |
| 3,810,548 | 5/1974 | Blough | 261/120 |
| 3,855,370 | 12/1974 | Dodd | 261/92 |
| 3,911,065 | 10/1975 | Martin et al. | 261/120 |
| 4,060,574 | 11/1977 | Verner et al. | 261/120 |
| 4,163,636 | 8/1979 | Botsch et al. | 415/6 |
| 4,190,619 | 2/1980 | Cherne | 261/120 |
| 4,409,107 | 10/1983 | Busch | 261/120 |
| 4,482,510 | 11/1984 | Khudenko | 261/120 |
| 4,681,711 | 7/1987 | Eaton | 261/120 |
| 4,732,682 | 3/1988 | Rymal | 261/120 |
| 4,734,235 | 3/1988 | Holyoak | 261/120 |

*Primary Examiner*—Michael Koczo
*Assistant Examiner*—Charles G. Freay
*Attorney, Agent, or Firm*—Hoffman, Wasson & Gitler

[57] ABSTRACT

An aerator or destratifier used in small bodies of water is provided with a sealed flotation chamber in which a motor is completely housed. A stationary shaft runs between the top and bottom surface of the flotation chamber onto which the motor is mounted. A plurality of paddles is externally affixed to the exterior surface of the flotation chamber. A V-belt, a chain or a gearing arrangement is provided between the motor and the internal surface of the flotation chamber which will enable the flotation chamber to constantly or intermittently rotate. The plurality of paddles would then agitate the body of water and allow oxygen to be dissolved therein.

7 Claims, 3 Drawing Sheets

POND WATER DESTRATIFIER

This is a divisional of copending application Ser. No. 07/668,183 filed on May 12, 1991.

BACKGROUND OF THE INVENTION

It is generally known that unless there is considerable activity, such as boating, swimming, water skiing and the like, on a particular small body of water, the water will stagnate and become cloudy. Additionally, it is recognized that this type of water would have a low level of dissolved oxygen which is known as a major source of fish kills in water used to raise various aquatic animals, such as catfish. If the circulation of the water is not maintained by natural or artificial means, the water would have a tendency to "stratify", manifested by different levels of dissolved oxygen and different water temperatures at different depths. This stratification can have a disastrous effect on the health and condition of the developing fish.

Two basic forms of aerators and destratifiers have been utilized to prevent the development of stratification in these ponds. These aerators and destratifiers operate by either spraying jets of water into the air or by agitating the water by use of one or more mechanical paddle wheels or similar agitators.

Mechanical paddle wheel devices in common use today all employ external flotation devices, paddle wheels attached to external drive shafts, and drive motors mounted on a frame that exposes them to water and atmospheric conditions. The motor, frame and flotation devices are stationary and drive the paddle wheel by use of this external shaft which rotates in bearings.

Many problems in manufacturability and reliability are inherent in these designs. Obviously, exposure of the motor demands either an expensive weather-proof motor or a weather shield or housing surrounding the motor. The shaft and bearings must also be designed so as to resist the deleterious effects of the weather. Furthermore, they must also be carefully maintained and periodically lubricated because of their direct exposure to the water. These components will constantly collect algae and water-born deposits that will also require periodic cleaning and maintenance. Surmounting these inherent problems adds considerably to the costs of manufacturing and operating these agitators and destratifiers.

U.S. Pat. No. 3,322,410 issued to Ahlenius, U.S. Pat. No. 3,911,065 issued to Martin et. al., U.S. Pat. No. 4,409,107 issued to Busch and U.S. Pat. No. 4,681,711 issued to Eaton are typical of these prior art water agitator devices. For example, the patent to Busch describes a method and apparatus for aerating bodies of water utilizing a rotating paddle wheel having a plurality of paddles mounted on a shaft. The paddle wheel is powered by a motor which is provided under an arch-like motor cover to shelter it from rain and other adverse elements. The patent to Ahlenius illustrates a water purification unit for use on small bodies of water to remove surface algae and the like. The unit contains a paddle wheel provided within a box. A motor is provided on the top wall of the box and drives the paddle wheel by means of a chain affixed to a sprocket connected to the motor drive shaft and a second sprocket affixed to the axle of the paddle wheel. Both the patents to Martin et. al. and Eaton describe liquid aerators provided with an uncovered motor.

SUMMARY OF THE INVENTION

The present invention overcomes the deficiencies of the prior art by providing an aerator having a drum containing a plurality of paddles affixed to the outer surfaces of the drum. The interior of the drum is provided with a stationary tubing or shaft connected to the drum by sealed bearings. A motor powered by either an internal source, such as a battery, or an external source, is provided in the interior of the drum. The motor is connected to a pulley system which rotates the drum by providing a V-belt or similar device which turns the belt on the sealed bearing. Alternatively, the paddles can be replaced by buckets which would be utilized as a water lift to transport water from one level to a second level in which the fish or other aquatic animals could inhabit.

These and further features and advantages of the present invention will become apparent from the following detailed description, wherein reference is made to the figures in the accompanying drawings.

DETAILED DESCRIPTION OF THE PRESENT INVENTION

Figure 1:
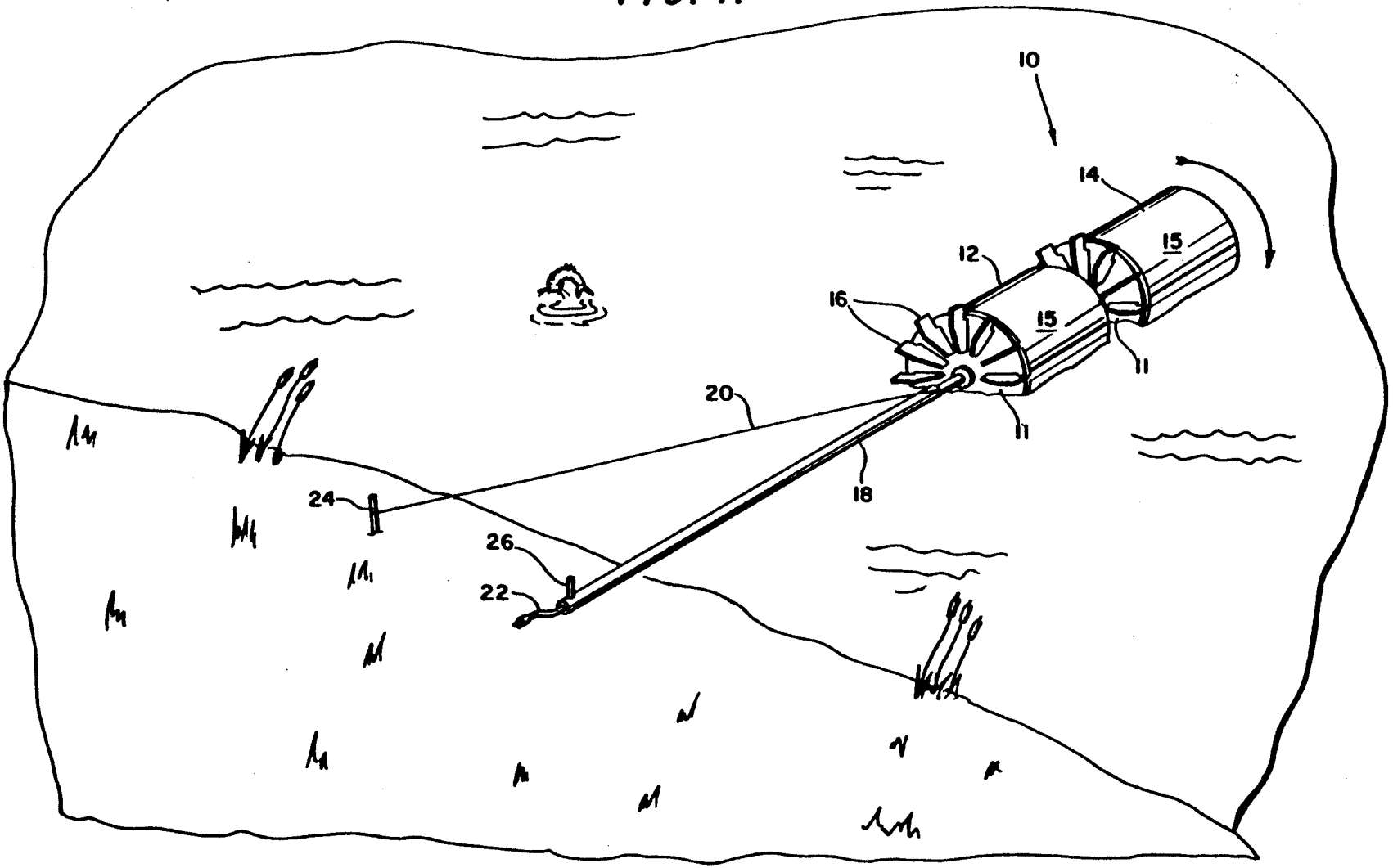
FIG. 1 is a pictorial view of one embodiment of the present invention operating in a fish pond.

FIG. 1 illustrates the present invention utilized to aerate a fish pond or other small body of water. The invention 10 consists of one or more sealed flotation chambers 12, 14 which are immersed in the water to approximately its midpoint. A plurality of paddles 16 are integrally attached to the bottom or top surface 11 of the sealed chamber 12, 14. Each of the chambers is provided with a periphery surface 15 surrounding all of the internal mechanisms.

The chamber, or chambers, are anchored in place utilizing a cable 20 as well as a solid or hollow elongated tube 18. Both the tube 18 and the cable 20 are secured to the ground utilizing stakes 24, 26. If the tube is hollow, an electrical cord 22 extends within the tube from a source of external electricity provided on the shore surrounding the body of water to a motor provided within the sealed chamber.

Figure 2:
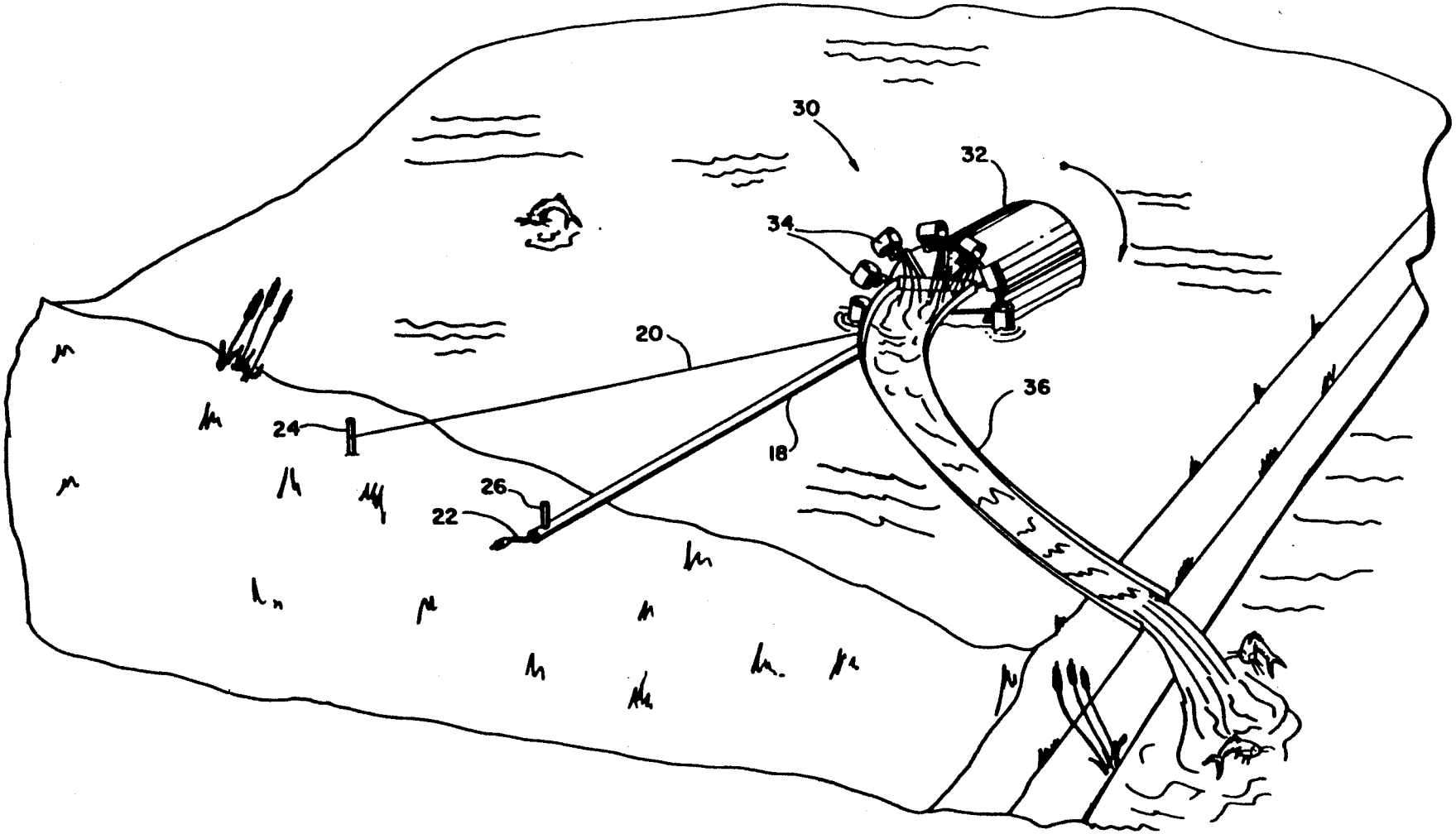
FIG. 2 is a pictorial view of a second embodiment of the present invention operating as a water lift.

FIG. 2 illustrates a second embodiment of the present invention 30 in which a single sealed flotation chamber 32 is provided with a plurality of water buckets 34. Rotation of these water buckets causes water to be lifted from the pond and onto a slide 36 which would deposit the water on another level containing the fish. This embodiment is secured to the ground a manner similar to that of the first embodiment. Additionally, the tube 18 is either hollow or solid. If the tube is hollow, an electrical cord is provided therein to supply electricity to the internal motor.

It is noted that common elements of FIG. 1 are denoted by the same reference numerals in FIG. 2.

Figure 3:
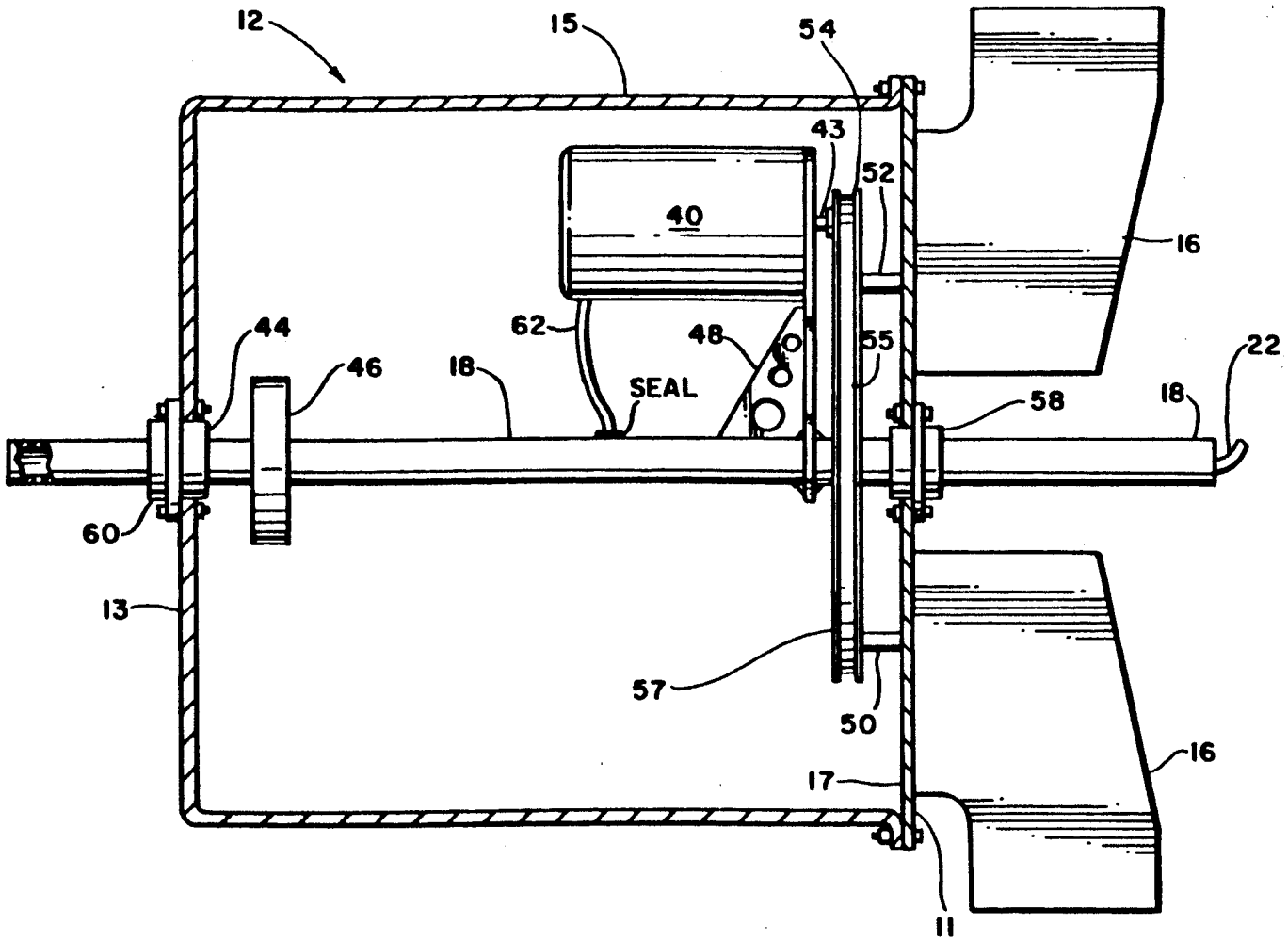
FIG. 3 is a schematic drawing of the paddle wheel assembly of FIG. 1.

The paddle wheel assembly of the present invention illustrating the internal structure of the sealed flotation chamber is shown with respect to FIG. 3. It is noted that although this figure is illustrated with respect to the paddles 16 of FIG. the water buckets 34 shown in FIG. 2 can be substituted for the paddles 16.

The sealed flotation chamber 12 can be cylindrical in shape having a periphery 15 and top and bottom surfaces 11, 13. The bottom surface 13 is joined to the remainder of the flotation chambers by bolts or other similar devices. The paddles 16 are integrally connected to the outside surface of the bottom 13.

A motor 40 is provided totally within the flotation chamber 12 and is mounted on a bracket 48 such that the motor is provided above the water line of the body of water. The bracket 48 would attach the motor 40 to the internal portion of the stationary shaft or tubing 18. In one embodiment, the internal drive shaft of the motor 43 is connected to a drive pulley 54. A V-belt 55 is driven around the pulley 54, as well as a second pulley 57. The driven pulley is mounted to the internal surface of the drum 17 utilizing several standoffs 50, 52. Alternatively, the drum can be driven utilizing a chain and sprockets instead of the V-belt and V-pulleys. Furthermore, another embodiment could utilize a ring gear and pinion gear instead of the V-belt and V-pulleys. Sealed bearings 58 and 60 are directly mounted to the stationary shaft. Because these bearings are mounted inside the housing of the device, they need not be specially waterproofed, and periodic maintenance and lubrication caused by exposure to the water are not required. Similarly, since the motor 40 is mounted completely inside of the flotation chamber, as well as always maintained above the water line, a specially designed waterproof motor need not be utilized. A balance weight 46 may be provided on the interior portion 42 of the stationary shaft, if desired, for ballast.

The motor may be powered internally by one or more batteries or can be powered externally by a source of electricity provided directly on the land. If this is the case, the power cord 22 connects this source of electricity to the motor through the interior of the shaft 18. A wire 62 can connect the power cord 22 directly to the motor 40. This wire 62 is sealingly connected to the stationary shaft 18. Alternatively, an internal power supply, such as a battery, can be included within the sealed chamber 12 to enable the paddles to rotate.

None of the external parts of the flotation chamber are stationary in the water. All of these exposed parts are constantly in motion, and therefore are much less likely to gather algae, water-born deposits or other corrosive products. Furthermore, the efficiency of the present invention is improved since the interior of the flotation chamber is constantly cooled by the rotation of the drum in the water, thereby providing a lower temperature in the interior of the drum.

Since more than one flotation chamber can be connected together and thereby run off of one external source of power, the stationary shaft 18 can pass through one of the flotation chambers and through to a second flotation chamber as noted by reference numeral 56. In operation, the destratifier is floated to a position in the pond and its stationary shaft is fixed by stakes 24, 26 and the stabilizing cable 20 to the ground. In operation, the flotation chamber serves as a flotation device, a weather shield and a paddle wheel.

When the motor begins to operate utilizing either an internal or external source of electricity, the motor 40 would turn the drum 12 on its sealed bearings 58, 60 by means, in a first embodiment, of the V-belt around the motor and the drum pulleys 54, 57. The action of the paddles 16 on the outside of the drum agitates the water, establishing currents that mix the water and effectively prevent stratification. At the same time, the splashing of the paddles in the water also injects additional oxygen into the water, thereby raising the oxygen or aeration level of the pond. High dissolved oxygen levels produce healthier fish with fewer losses and allow higher stocking rates of fish per acre of pond.

While preferred embodiments of the present invention have been shown and described in detail, it is to be understood that many adaptions and modifications can be made to the invention by those skilled in the art, without departing from the spirit and scope of the invention, as set forth in the claims.

What is claimed is:

1. A water lift used to transport water from one body of water to a second body of water surrounded by a shoreline, comprising:

an enclosed, sealed flotation chamber having top and bottom surfaces and a continuous side surface extending between said top and bottom surfaces to form an enclosed chamber therebetween, said top, bottom and side surfaces including both interior and exterior surfaces, said chamber capable of rotation and adapted to be provided in one body of water;

a stationary shaft extending between said top and bottom surfaces of said flotation chamber;

a plurality of water buckets affixed to one or more of said exterior surface of said flotation chamber;

a motor provided with an internal drive shaft, said motor included totally within said flotation chamber, said motor mounted on said stationary shaft, said motor powered by a source of electricity;

motion transmitting means provided between said internal drive shaft of said motor and the interior surface of said flotation chamber;

a water slide having a first end situated beneath said water buckets and a second end situation above and in proximity with the second body of water; and wherein application of the source of electricity to said motor provides rotation of said flotation device, allowing said water buckets to load water onto said first end of said water slide allowing the water to flow from the first body of water to the second body of water.

2. The water lift in accordance with claim 1, wherein said stationary shaft extends beyond the top and bottom surface of said flotation chamber and further include sealed bearings mounted on said stationary shaft at the juncture of said shaft at the top and bottom surfaces.

3. The water lift in accordance with claim 1, wherein said motor is powered by a source of electricity provided completely within said flotation chamber.

4. The water lift in accordance with claim 2, wherein said shaft is hollow and said source of electricity is provided beyond the shoreline, and extends between the shoreline and said flotation chamber, and further including a power cord extending between said source of electricity and said motor.

5. The water lift in accordance with claim 2 wherein said stationary shaft extends between said flotation chamber and the shoreline and further including a stabilizing cable extending between the shoreline and said stationary shaft at a point external to said flotation chamber, said stationary shaft and said stabilizing cable anchored to the shore by anchoring devices.

6. The water lift in accordance with claim 1, wherein said motion transmitting means includes a first pulley between said internal drive shaft and the interior surface of said flotation chamber, a second pulley connected to the interior surface of said flotation chamber and a V-belt provided around said first and second pulleys.

7. The water lift in accordance with claim 1, wherein said motion transmitting means includes a first chain sprocket on the internal drive shaft and a second chain sprocket connected to the interior surface of said flotation chamber and a chain provided between said first and second pulleys.

* * * * *